US005493349A

United States Patent [19]

Barhydt et al.

[11] Patent Number: 5,493,349

[45] Date of Patent: Feb. 20, 1996

[54] CASE-STAND FOR AN EYEWEAR SYSTEM

[75] Inventors: Dirck Barhydt, Middlebury, Conn.; Eugene R. Ogman, S. Salem, N.Y.

[73] Assignee: BP Partners, Middlebury, Conn.

[21] Appl. No.: 341,646

[22] Filed: Nov. 17, 1994

[51] Int. Cl.[6] ..... G02C 1/00; A45C 11/04

[52] U.S. Cl. ..... 351/158; 351/114; 206/5; 206/6

[58] Field of Search ..... 351/158, 114, 351/111; 206/5, 6

[56] References Cited

U.S. PATENT DOCUMENTS 4,202,609 5/1980 Reese ..... 351/111
5,042,933 8/1991 Lear ..... 351/111

FOREIGN PATENT DOCUMENTS 0201324 2/1923 United Kingdom ..... 206/6
0210632 11/1923 United Kingdom ..... 206/6

*Primary Examiner*—William L. Sikes
*Assistant Examiner*—James A. Dudek
*Attorney, Agent, or Firm*—Dallett Hoopes

[57] ABSTRACT

The case and stand for use with eyewear having filament-type temple pieces is a rectangular bed defined by a base panel and upwardly extending rigid side panels at the opposite ends thereof. To the upper ends of the side panels leaves are pivotally supported and the tops of the leaves are notched to receive respectively the pairs of strands. The leaves are each provided with earpiece retainers on the outside faces thereof so that the filaments can train over the top of the leaves respectively and the earpieces fit in the retainers, the lenses thereby suspended below. U-shaped covers are pivoted to the outer ends of the base panel so that in one position they can form pedestals for supporting the bed to be a stand, or when the leaves are folded inward can be flipped around to be a two-piece cover for the case.

8 Claims, 4 Drawing Sheets

CASE-STAND FOR AN EYEWEAR SYSTEM

BACKGROUND OF THE INVENTION

This invention relates to a case-stand for an eyewear system. More specifically, the invention relates to a case-stand which serves as a case and stand for eyewear comprising a pair of lenses held spaced apart by a central nosepiece and having temple elements in the form of thin filaments.

There has been developing a popularity for eyewear of the type as described in U.S. Pat. No. 4,202,609 to Donald M. Reese, issued May 13, 1980 and U.S. Pat. No. 5,042,933 to David R. Lear issued Aug. 27, 1991. Such "suspension" eyewear, as it has been called, initially looks like a pince-nez. However, the lenses are actually supported adjacent to their outside edges respectively by pairs of almost invisible thin flexible retaining filaments of plastic. On each side of the eyewear these filaments are attached at their forward ends at spaced points to the lens, and are attached at their rearward ends to the forward end of a question-mark-shaped earpiece. "Filament" as used herein includes any flexible strand, wire or line.

Such eyewear systems have the advantages of security of position and comfort not afforded by the ordinary metal or plastic rigid temple bar eyewear. Because of this security, such eyewear systems have the desirable advantage of always being in the same position relative to the eye - - - at the proper angle and at the proper distance from the eye. They will not slide down one's nose in a tennis game. They will not fly off in contact sports. In general, they are not susceptible to being dislodged by movement as experienced during active sports or other activities. This security is a great convenience. Further, the sure alignment at a given spot, angle and place relative to the position of the eye minimizes distortion and makes for steadfast clarity of vision.

At the same time, the aforesaid comfort gives the wearer the impression that he has on no glasses at all. Eliminated are the oppressive rubbing of the nose pads on the sides of the nose, the weighting on the top of the ears, and the indenting of the temple bar against the side of the head forward of the ear. Because these glasses have no rigid temple bars, are rimless and are made from lightweight plastic such as polycarbonate, the never-before-experienced comfort and freedom are remarkable to the wearer.

Users of the eyewear system thus described have been occasionally inconvenienced by having the retaining filaments and earpieces become tangled when the system is set down on the bathroom sink or bedside table. It has, therefore, taken a moment to untangle the strands before putting them back on. The untangling has, of course, involved the repositioning of the earpieces, and usually this is done after untangling by taking an earpiece in each hand so that the lenses are suspended below the earpieces and then hooking the earpieces over the ears one-by-one or simultaneously.

The inconvenience referred to above, though minor and merely pesky, has resulted in a call for some kind of support or stand for such glasses for periods of non-use whereby the two separate earpieces and their attached filaments are kept segregated one side from another and in a position whereby they can be readily picked up by the earpieces and returned to normal wearing position. In addition, a sturdy protective traveling case holding the system in untangled attitude has been sought. It is with a case-stand for "managing" such eyewear that the present invention is concerned.

SUMMARY OF THE INVENTION

The invention, therefore, for eyewear as described is a case-stand comprising a rectangular bed having a base panel and upwardly extending rigid side panels at the opposite ends thereof. Pivoting leaves are hingedly supported on the top of the side panels and the tops of the leaves are notched to have trained thereover respectively the pairs of filaments. On their outside faces the leaves are provided with earpiece retainers so that the earpieces can be held in the respective retainers, the lenses thereby being suspended below. U-shaped covers are pivoted to the opposite ends of the bed so that in one position the covers can form substantial spaced pedestals or pillars for supporting the bed to comprise a stand, or, when the leaves are folded inward, the covers can be flipped outward and up to comprise a two-piece protective cover for the case.

BRIEF DESCRIPTION OF THE DRAWINGS

Further objects and features of the invention will be understood by those skilled in the art from reference to the following specification including the drawings, all disclosing a non-limiting form of the invention. In the drawings.

DESCRIPTION OF THE PREFERRED EMBODIMENT

Figure 1:
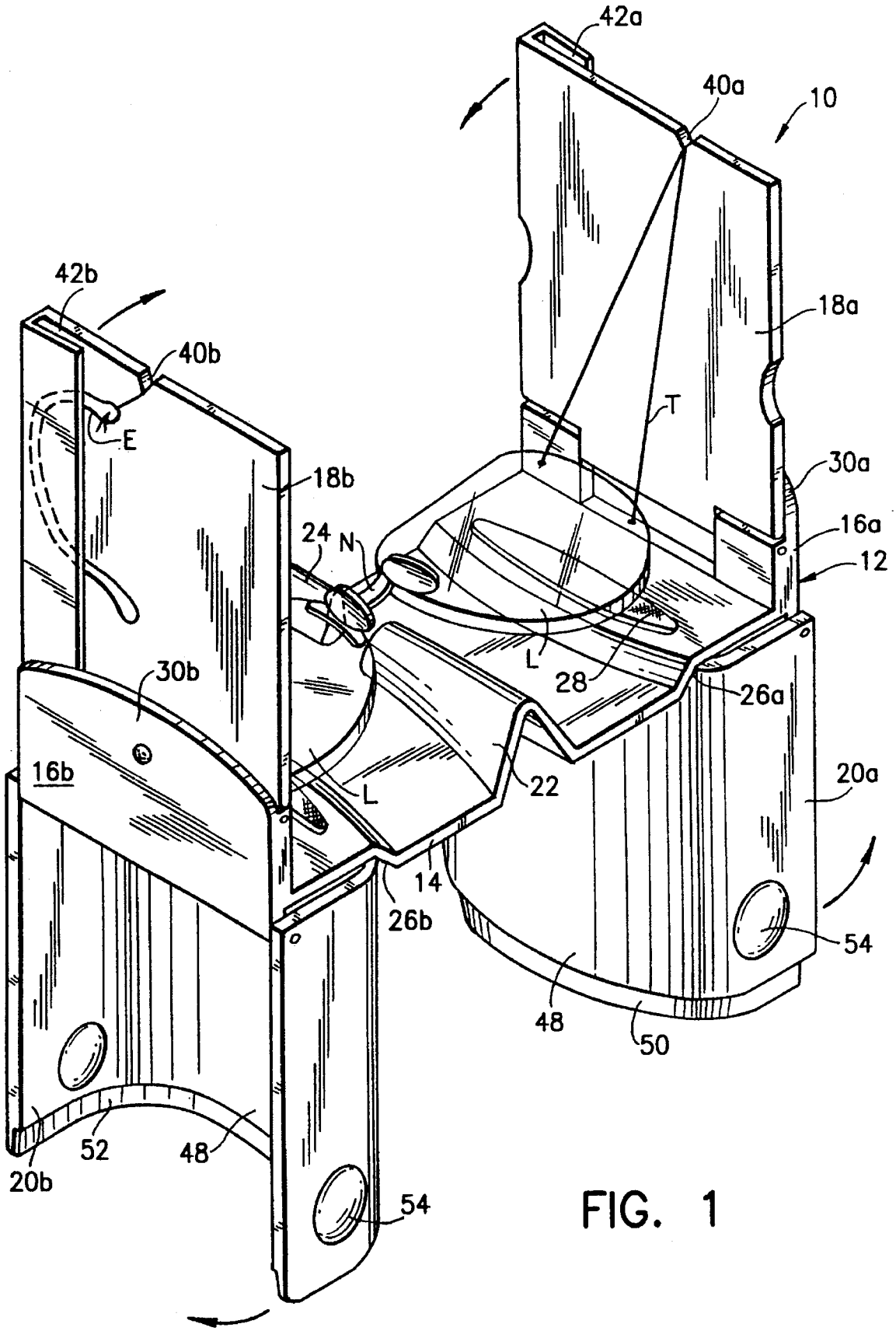
FIG. 1 is a perspective view of a case-stand for eyewear embodying the invention and set up to comprise a stand for the support of the eyewear system as would be useful beside a bathroom sink or on a bedside table.

An eyewear case-stand embodying the invention is shown in FIG. 1 and is generally designated 10. In FIG. 1 the case-stand is shown in the form of a stand with the eyewear having thereon as would be the case on a bedside table.

Figure 3:
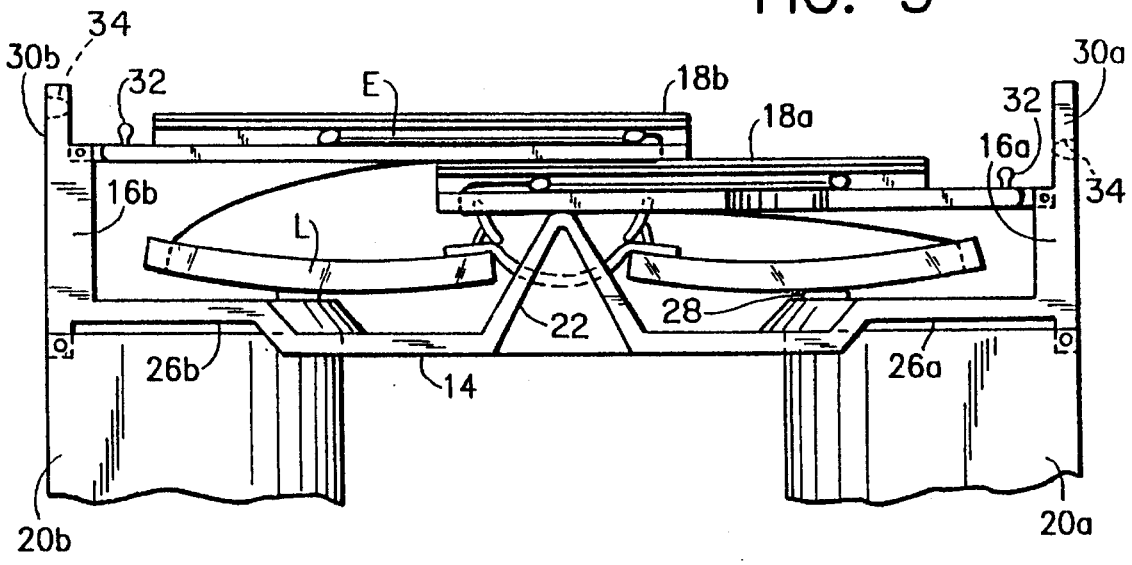
FIG. 3 is a front elevational view and showing an embodiment of the invention with the leaves folded down and the eyewear in place.

The case-stand comprises a rectangular bed 12 having a base panel 14 and unitary rigid side panels **16*a*, 16*b* extending up at the opposite ends thereof. Pivoted to the side panels by pins as shown are the support leaves 18*a*, 18*b*. The side panels also extend downwardly a short distance (FIG. 3) and have pinned thereto in pivotal connection the channel-shaped covers 20*a* and 20*b***.

As shown in FIG. 1, the eyewear, comprising the lenses L, the nosepiece N, the temple filaments T and the earpieces E is hung in the case by having the temple filaments T extend up over the leaves **18*a*, 18*b* with the earpieces retained on the outside of the leaves. With the eyewear thus suspended with the lenses L spaced above the base panel 14, the leaves can be folded (FIG. 3) so that the eyewear rests on the base panel 14 and the covers 20***a*, 20*b* can be pivoted 270° about their pivot pins to close over the eyewear and leaves to form the case shown in FIG. 4.

Now, in more detail, the rectangular bed 12 has its base panel shaped to conform to its purposes. Across the base panel in the middle thereof there is an upward stabilizing hump 22. This hump is bifurcated, leaving a gap 24 intermediate its ends to receive the nosepiece N. For the purpose of receiving on its underside the top ends of the covers 20*a*, 20*b*, the bed is formed with upward recesses 26*a*, 26*b*. The upper surface of the bed in this area may be covered with a felt 28.

Figure 7:
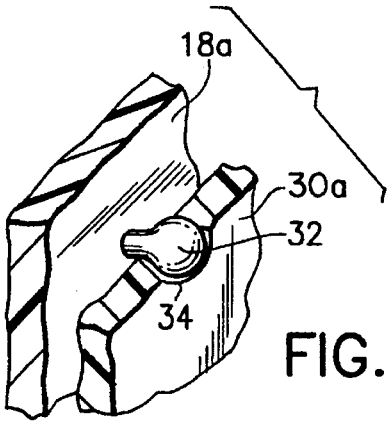
FIG. 7 is an enlarged fragmentary perspective view of the means for holding the leaves in their vertical position.

The side panels 16*a*, 16*b* can be reduced above the pivotal connection with the leaves to comprise the back stops 30*a*, 30*b* to serve as an outward limit for the pivoting of the leaves 18*a*, 18*b*. For the purpose of securing the leaves in the upward position, detents are provided in the form of little heads 32 extending out from the leaves 18*a*, 18*b* (FIGS. 3, 7) which pop into sockets 34 in the extensions 30*a*, 30*b*.

Figure 5:
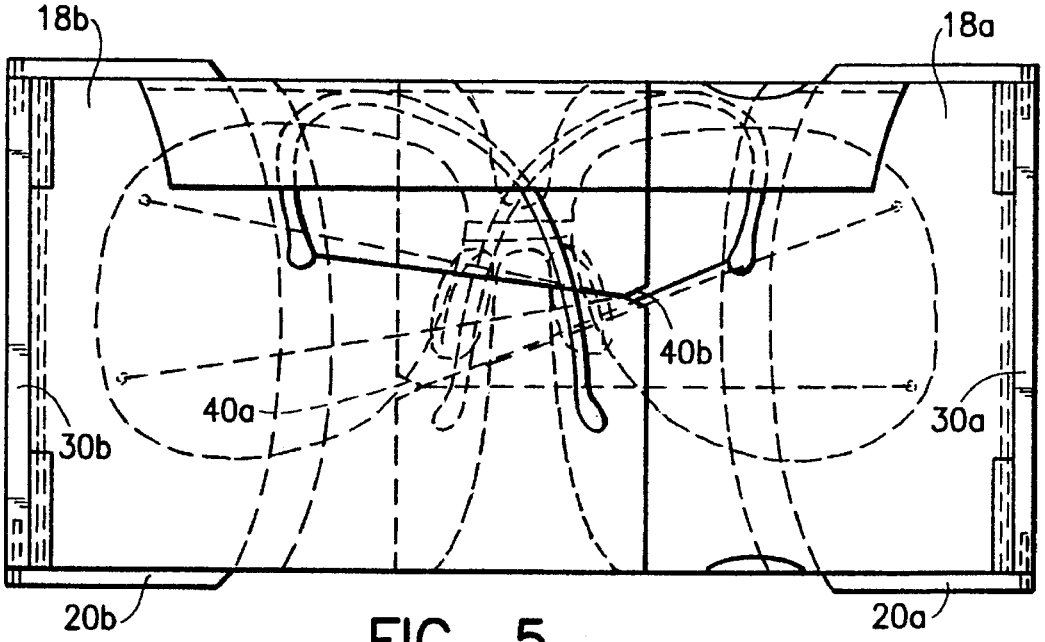
FIG. 5 is a top view of FIG. 3 showing the eyewear in phantom.
Figure 6:
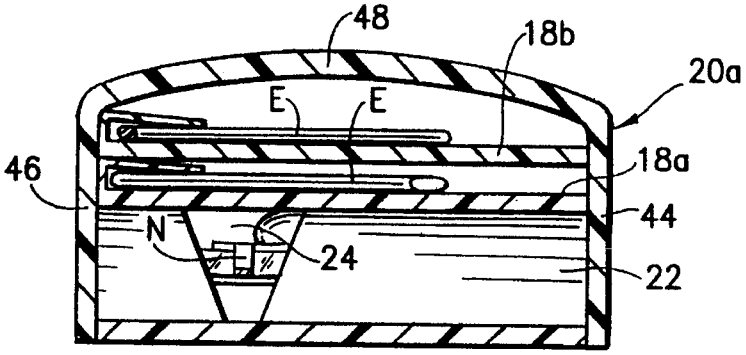
FIG. 6 is a transverse sectional view taken along the line 6—6 of FIG. 4.

At the upper ends 40 the leaves 18*a* and 18*b* are notched as at 40*a* and 40*b* respectively. In order to avoid interference, the notches are offset with respect to the length of the top edge as shown in FIG. 5, the notch 40*a* being closer to the front of the stand than the corresponding notch 40*b* on the other leaf.

The outward faces of the leaves 18*a*, 18*b* double back to present earpiece retainers or pockets 42*a*, 42*b* into which the earpieces E may be slipped as shown.

As described and shown in FIG. 1, the covers 20*a* and 20*b* are also pedestals for the stand and are generally channel-shaped comprising the parallel leg webs 44 and 46 and a connecting web 48. Each cover is approximately one-half the length of the rectangular bed 12, and the covers are pivotally secured by the corners of their leg webs to the front and back of the opposite ends of the bed.

Figure 8:
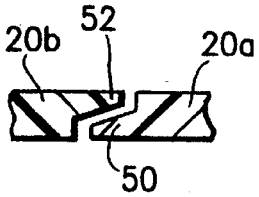
FIG. 8 is an enlarged fragmentary sectional view taken on the line 7—7 of FIG. 4.

As shown, the lower end of the cover 20*a* is recessed (FIG. 1) and tapered as at 50, and the inside of the other cover 20*b* is recessed and tapered in complementary fashion as at 52 so that when the covers are pivoted to closed position (FIG. 8), they form a gap-free surface excluding passage of dust into the interior of the case.

Figure 4:
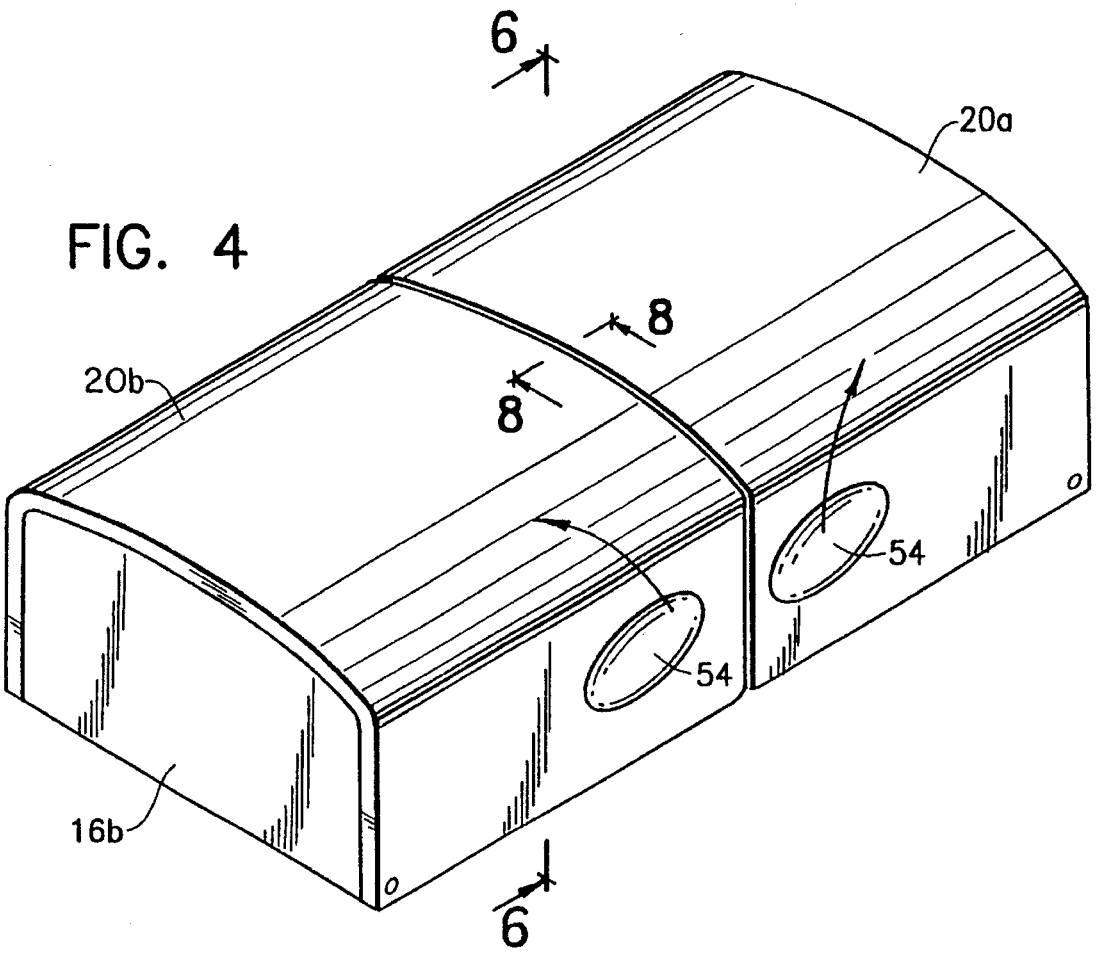
FIG. 4 is a perspective view of the eyewear case-stand of FIG. 1 folded and closed to form a travel case with the eyewear inside.

As shown in FIGS. 1 and 4, the outside of the leg webs 44, 46 may be formed adjacent their distal ends with shallow finger and thumb recesses 54 to facilitate manipulation. One-half a trademark or decoration may be embossed or otherwise presented on each of the inward ends of the central webs (FIG. 4) so that when the covers are closed, a continuum of the trademark results.

In transferring the eyewear in the morning, for instance, from the bedside table to the face, the wearer can simply stand over the stand (FIG. 1), grasp the right earpiece in the right hand and the left earpiece in the left hand. He then can raise the eyewear so that the nosepiece N engages the nose and simultaneously hook the earpieces over the ears. At night the reverse process puts the eyewear in the stand as shown in FIG. 1.

Figure 2:
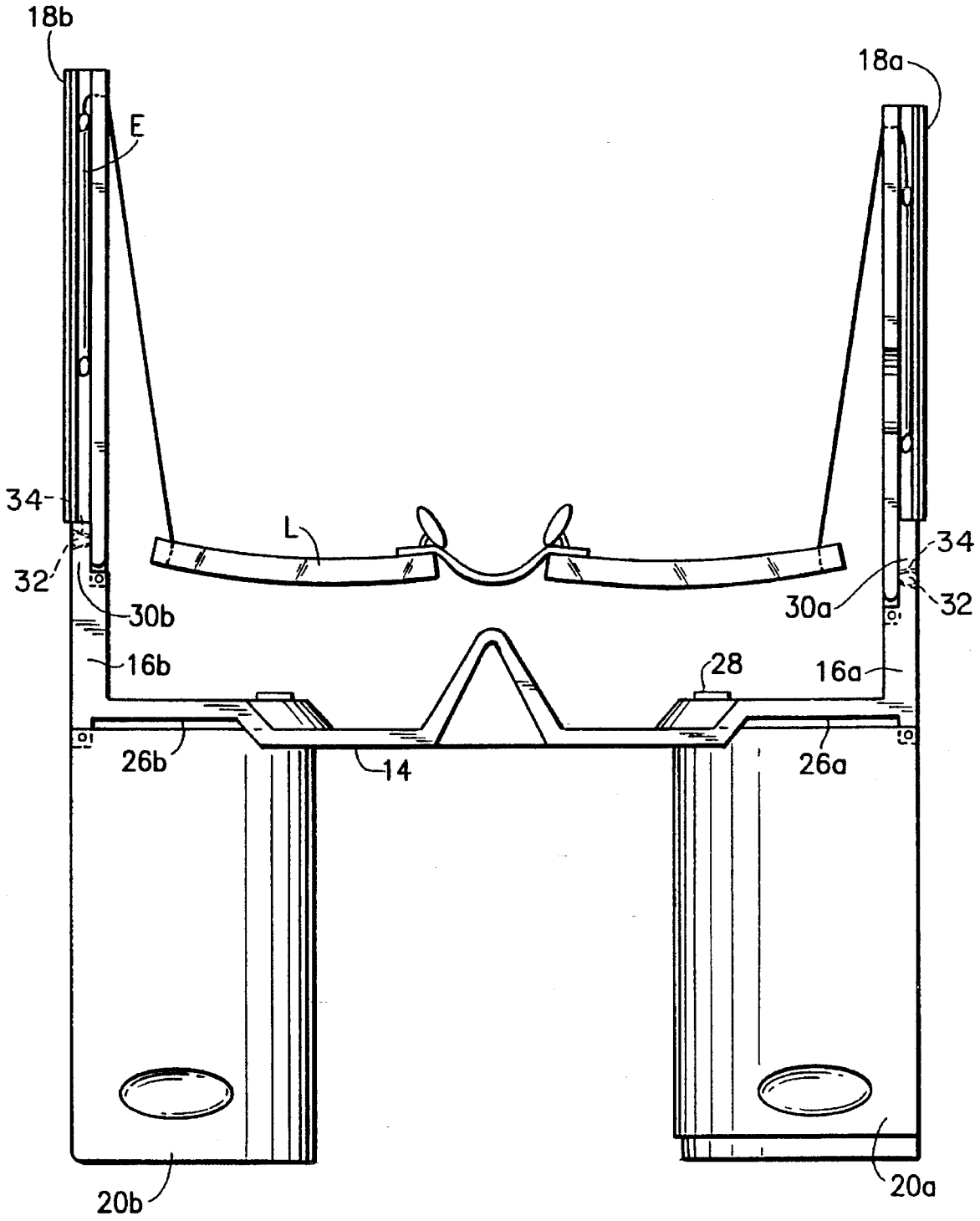
FIG. 2 is a front elevational view of the case-stand with the eyewear in place.

The parts of the case-stand as shown in FIG. 2 are such that the distance between the top of the leaves 18*a* and 18*b* and the surface of the base panel 14 is greater than the length of the filaments T so that when the eyewear is in the case-stand with the leaves up, the lenses L are suspended above the base and do not touch it. This avoids scratching the lenses.

The structure and operation of the case-stand of the invention having been described, it should be clear that there is thus presented a case-stand which provides means for storing temporarily as on a bedside table, or for longer periods as in travel to assure the management of the flexible temple filaments T and earpieces E in a way that they will not tangle. The case presents an easy receptacle for such eyewear, on a temporary or more permanent basis.

At the same time, when in the form of a stand, the invention makes a remarkable statement and unique appearance complementing the uniqueness of the eyewear itself with the substantial covers 20*a*, 20*b* providing substantial pedestals to support the eyewear and accentuate their importance. When pivoted closed the case provides a substantial, sturdy and unusual protective housing (FIG. 4).

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A case-stand for an eyewear system comprising lenses held spaced apart by a central nosepiece and having temple retainers on an outside edge of each lens, each retainer defined by a pair of flexible filaments, one end of the pair connected to spaced points on the lens respectively and the other end of the pair connected to an earpiece, the case-stand comprising:

a. a rectangular bed having a base panel and upwardly extending rigid parallel side panels at the opposite ends thereof, b. support leaves pivotally secured respectively to the side panels at locations spaced above the base panel, the leaves each having a notch in the most distal edge thereof intermediate its ends and the leaves having opposing faces and outward faces when the leaves are in an upward position, the leaves supporting an earpiece receiver on the outward face thereof, and c. a pair of channel-shaped covers having parallel leg webs and a connecting web, each cover being one half the length of the rectangular bed, the channel-shaped covers being pivotally secured at the opposite ends of the bed respectively, each pivot connecting at the distal ends of its leg webs to the opposite sides respectively of the bed whereby with the leaves in upward position and the covers pivoted to underneath and perpendicular to the bed to provide support pillars for the bed the lenses can be suspended over the bed by the pairs of filaments extending up to and travel over the notches in the side panels respectively, the receivers receiving the earpieces respectively, and with the leaves pivoted inward and down, the covers can be pivoted outward and upward 2700 over the side panels to close and become a continuous cover for the system.

2. A case-stand as claimed in claim 1 wherein a bifurcated stabilizing hump is formed in the base panel intermediate the side panels and is adapted to receive and entrap the nosepiece in the bifurcation, the hump supporting one of the leaves when the leaves are down.

3. A case-stand as claimed in claim 1 wherein detents are provided in the side panels to hold the leaves releasably in upward position.

4. A case-stand as claimed in claim 1 wherein the pivot of one of the leaves to its adjoining side panel is above the level of the pivot of the other of the leaves to its adjoining side panel.

5. A case-stand as claimed in claim 1 wherein a portion of the side panels outward of the leaves extend upward above the locations at which the leaves are pivoted to limit outward pivoting of the leaves and to comprise end closures for the case when the covers are closed.

6. A case-stand as claimed in claim 1 wherein the earpiece receivers are each in the form of a pocket along one vertical edge of the leaf facing the opposite vertical edge on the same leaf.

7. In combination, a. an eyewear system comprising spaced lenses having a central nosepiece and having temple retainers on an outside edge of each lens and each defined by a pair of flexible filaments, one end of the pair connected to spaced points on the lens respectively and the other end of the pair both connected to an earpiece, and b. a case-stand comprising a rectangular bed having a base panel and upwardly extending rigid parallel side walls at the opposite ends thereof, the upper end of each side wall being formed with a notch, and on the outside face thereof an earpiece retainer, the lenses being suspended over the base panel by the pairs of flexible filaments extending up to and over the notches in the side walls respectively, the retainers receiving the earpieces respectively.

8. An eyewear system as claimed in claim 7 wherein the side walls each comprise a side panel rigid with the base panel and a leaf pivoted to the upper end of each side panel and the case and stand further includes a pair of channel-shaped covers having parallel leg webs and a connecting web, each cover being one half the length of the rectangular bed, the channel-shaped covers being pivotally secured at the opposite ends of the bed respectively, each pivot connecting at the distal ends of its leg webs to the opposite sides respectively of the bed, whereby the covers, when pivoted to under the base panel, constitute support pillars and when the leaves are folded inward, the covers may be pivoted 270° over the base panel to become a continuous cover.

* * * * *